US006761469B2

(12) United States Patent
Wu

(10) Patent No.: US 6,761,469 B2
(45) Date of Patent: Jul. 13, 2004

(54) ELECTRICAL CONNECTING STRUCTURE FOR A LAMP

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 86 days.

(21) Appl. No.: 10/277,823

(22) Filed: Oct. 23, 2002

(65) Prior Publication Data

US 2004/0080935 A1 Apr. 29, 2004

(51) Int. Cl.[7] ..... H01R 33/00

(52) U.S. Cl. ..... 362/226; 362/391; 362/370; 403/322.2; 439/348

(58) Field of Search ..... 362/226, 254, 362/389, 391, 227, 249, 362, 368, 370, 382, 396, 404, 405, 406; 403/321, 326, 322.2; 439/296, 345, 348, 368, 253

(56) References Cited

U.S. PATENT DOCUMENTS 2,636,068 A * 4/1953 Perkins ..... 403/322.2
2,771,308 A * 11/1956 Vitcha et al. ..... 251/74
3,659,329 A * 5/1972 Walker ..... 403/11
3,678,439 A * 7/1972 Vetter ..... 439/253
3,793,685 A * 2/1974 Knecht ..... 439/348
4,159,161 A * 6/1979 Timmer ..... 439/803
4,610,496 A * 9/1986 Schwartz et al. ..... 439/348
5,632,643 A * 5/1997 Shepherd et al. ..... 439/368
6,682,303 B2 * 1/2004 Wu ..... 362/226

* cited by examiner

*Primary Examiner*—Sandra O'Shea
*Assistant Examiner*—Ismael Negron
(74) *Attorney, Agent, or Firm*—Troxell Law Office PLLC

(57) ABSTRACT

A connecting structure of lamp rod and lamp base for all kinds of for lamps, comprising a lamp base coupled to a side of the wire connection box and a lamp rod inserted into the interior of the lamp base; wherein a socket is coupled to an end of the lamp base, and a guiding hole is protruded from a side of the lamp base to provide an embedding member for the fixture, and the embedding member further comprises a steel ball placed in a guiding groove of the lamp base in advance, a spring disposed behind the steel ball, and a stopcock disposed at the rear end of the spring; working together with a blocking groove disposed at the position at the head of the lamp rod corresponsive to the embedding member for accommodating the insertion of the lamp rod such that the resumption of spring pushes the steel ball back into its original position, and the steel ball will press against and be stuck in the blocking groove for inserting the lamp rod into the lamp base. After the user has bought the lamp, the user just needs to insert the lamp rod into the lamp base.

3 Claims, 5 Drawing Sheets

ELECTRICAL CONNECTING STRUCTURE FOR A LAMP

BACKGROUND OF THE INVENTION

1. Field of the Invention

The present invention relates to a do-it-yourself connecting structure of lamp rod and lamp base; by means of a guiding hole protruded from a side of the lamp base, an embedding member coupled onto the guiding hole, and working together with a blocking groove disposed at the position at the head of the lamp rod corresponsive to the embedding member of the lamp base, the present invention provides a way to let the head of the lamp rod push the steel ball backward and compress the spring so that after the lamp rod is inserted, the resumption of the spring pushes the steel ball back to its original position, and the steel ball presses against the blocking groove to insert the lamp rod into the lamp base. Such arrangement enables users to assemble the lamp on their own.

2. Description of the Related Art

The conventional structure of inserting a conductive set of a lamp, regardless a wall lamp, a table lamp, or a floor lamp, uses screws and nuts for the fixing. However, this kind of assembly by screws and nuts may easily collide the finished goods during the assembling, and has to use working tools such as wrench and screwdriver for the fixing. The friction produced during the assembling may expose the electric wire easily and may even cause the hazard of electric shock. Therefore, the traditional way causes trouble for the assembling, and is definitely not suitable for DIY users to assemble the lamp by themselves. The manufacturers have to assemble the wire connection box with the lamp rod first before selling the lamp, which may increase the cost. In view of these shortcomings, the inventor of the present invention based on years of experience accumulated from the engagement in the related industry conducted extensive research to resolve the aforementioned shortcomings and invented the present invention.

SUMMARY OF THE INVENTION

The primary objective of the present invention is to provide a do-it-yourself connecting structure of lamp rod and lamp base, comprising a lamp base coupled to a side of the wire connection box and a lamp rod inserted into the lamp base; wherein a socket is coupled to an end of the lamp base, and a guiding hole is protruded from a side of the lamp base to provide an embedding member for the fixture, and the embedding member further comprises a steel ball placed in a guiding groove of the lamp base beforehand, a spring disposed behind the steel ball, and a stopcock disposed at the rear end of the spring; working together with a blocking groove disposed at the position at the head of the lamp rod corresponsive to the embedding member for accommodating the insertion of the lamp rod such that the resumption of spring pushes the steel ball back into its original position, and the steel ball will press against the blocking groove to insert the lamp rod into the lamp base. After the user has bought the lamp, the user just needs to insert the lamp rod into the lamp base for the application, and thus enables users to assemble the lamp on their own.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
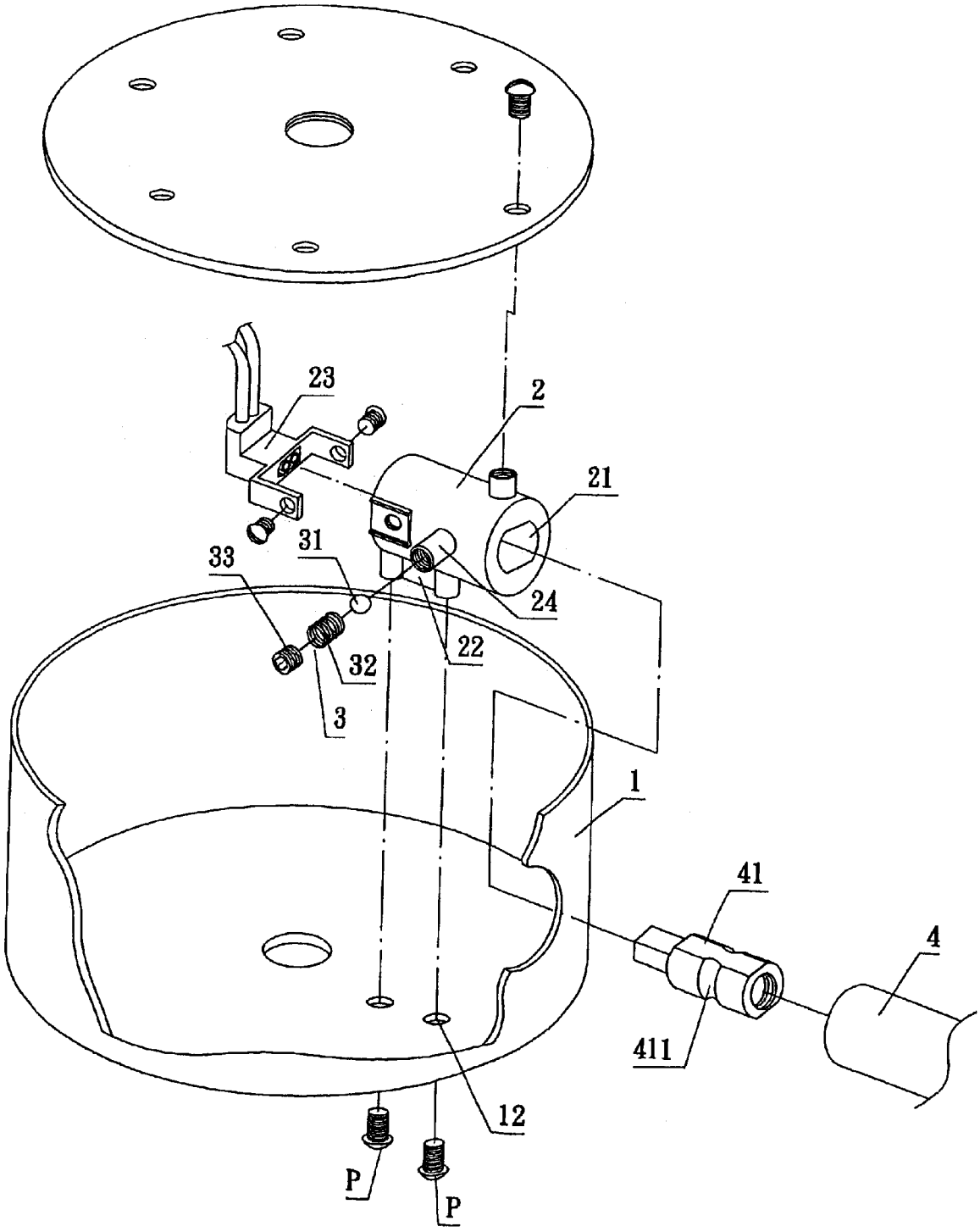
FIG. 1 is an explosive diagram showing the components of the present invention.
Figure 2:
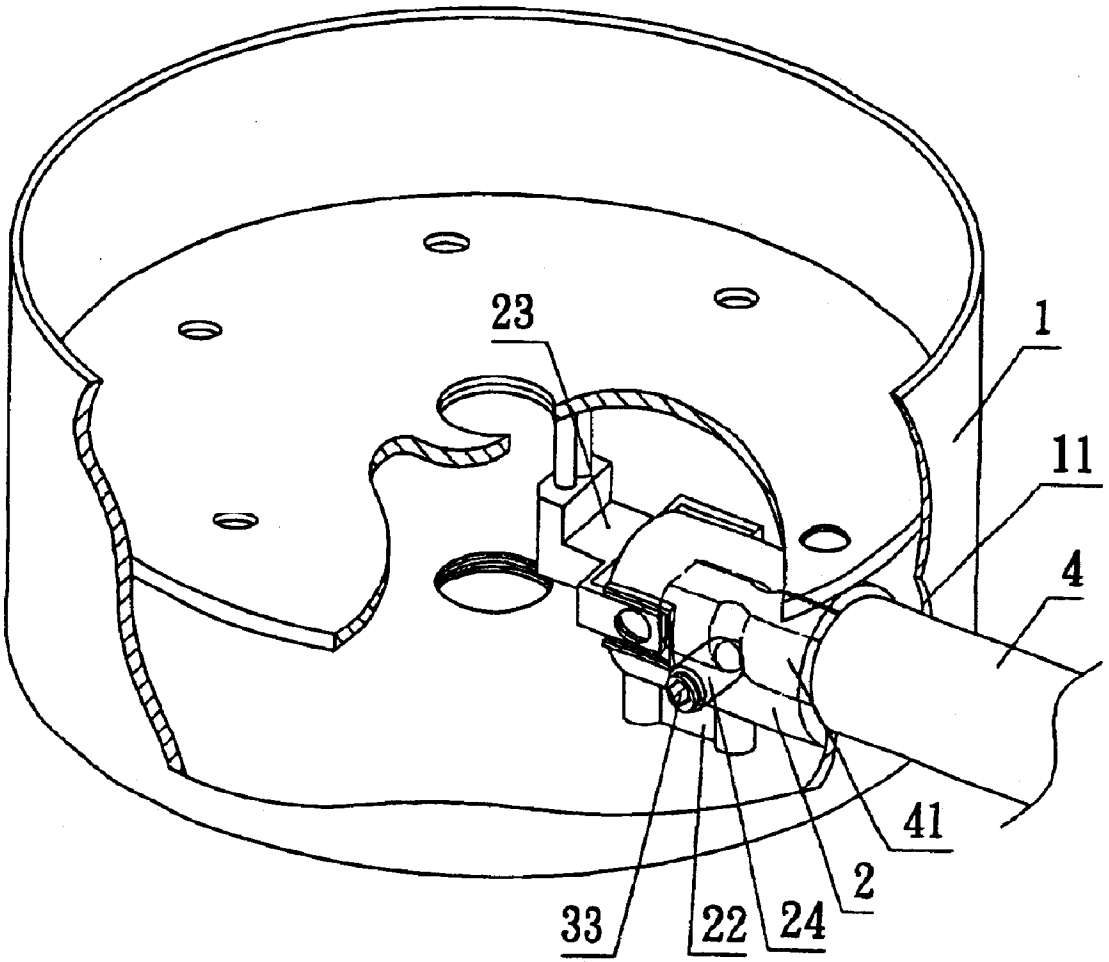
FIG. 2 is an assembled diagram of the present invention.

Please refer to FIGS. 1 and 2 for a clear understanding of the structure and mode of the present invention. The do-it-yourself connecting structure of lamp rod and lamp base of the present invention comprises a lamp base 2 coupled to a side of the wire connection box 1, an embedding member 3 disposed in the interior of the lamp base, and a lamp rod 4 inserted into the interior of the lamp base 2; wherein:

- a through hole 11 is disposed on a side of the wire connection box 1, and a screw hole 12 is disposed on the bottom surface of the corresponsive of the wire connection box for receiving a screw bolt and fixing the lamp base 2 in a secure position;
- a sheathing hole 21 is disposed on the lamp base 2 corresponsive to the through hole 11 of the wire connection box, and a locking base 22 is protruded from the bottom surface of the lamp base 2 corresponsive to the screw hole 12 of the wire connection box, such that the screw bolt P can pass through the screw hole 12 at the bottom end of the wire connection box 1 and be secured on the locking base 22. The lamp base 2 is fixed into the interior of the wire connection box 1. A socket 23 is disposed at an end of the lamp base 2, and such socket 23 can accommodate the insertion and leaning of the head 31 of the embedding member 3. The electric wire is installed in the socket first, and then is put into the mold for the integral shooting formation in order to assure the electric wire in the socket will not be loosened. Further, a guiding hole 24 is protruded from the side end of the lamp base 2 for engaging the embedding member 3 for the fixing; such embedding member 3 comprises a steel ball 31 placed in the guiding groove 24 in the lamp base in advance, a spring 32 disposed at the rear end of the steel ball 31, a stopcock 33 disposed at the rear end of the spring 32, and the diameter of the guiding hole 24 at the front end of the steel ball 31 is slightly smaller than the diameter of the steel ball 31 such that the steel ball 31 is pressed by the spring 32 and will protrude from the inside of the guiding hole 24, but will not fall out form the inside of the guiding hole 24 in order to accommodate the lamp rod 4 and the fixing.

The head 41 at an end of the lamp rod 4 is substantially shaped corresponsive to the shape of the sheathing hole 21, and the head 41 has a blocking groove 411 at the position corresponsive to the embedding member 3 of the lamp base 2. After the lamp rod is inserted into the lamp base 2, the head at the end will be inserted exactly into the socket 23 of the lamp base 2 to conduct electricity.

Figure 3A:
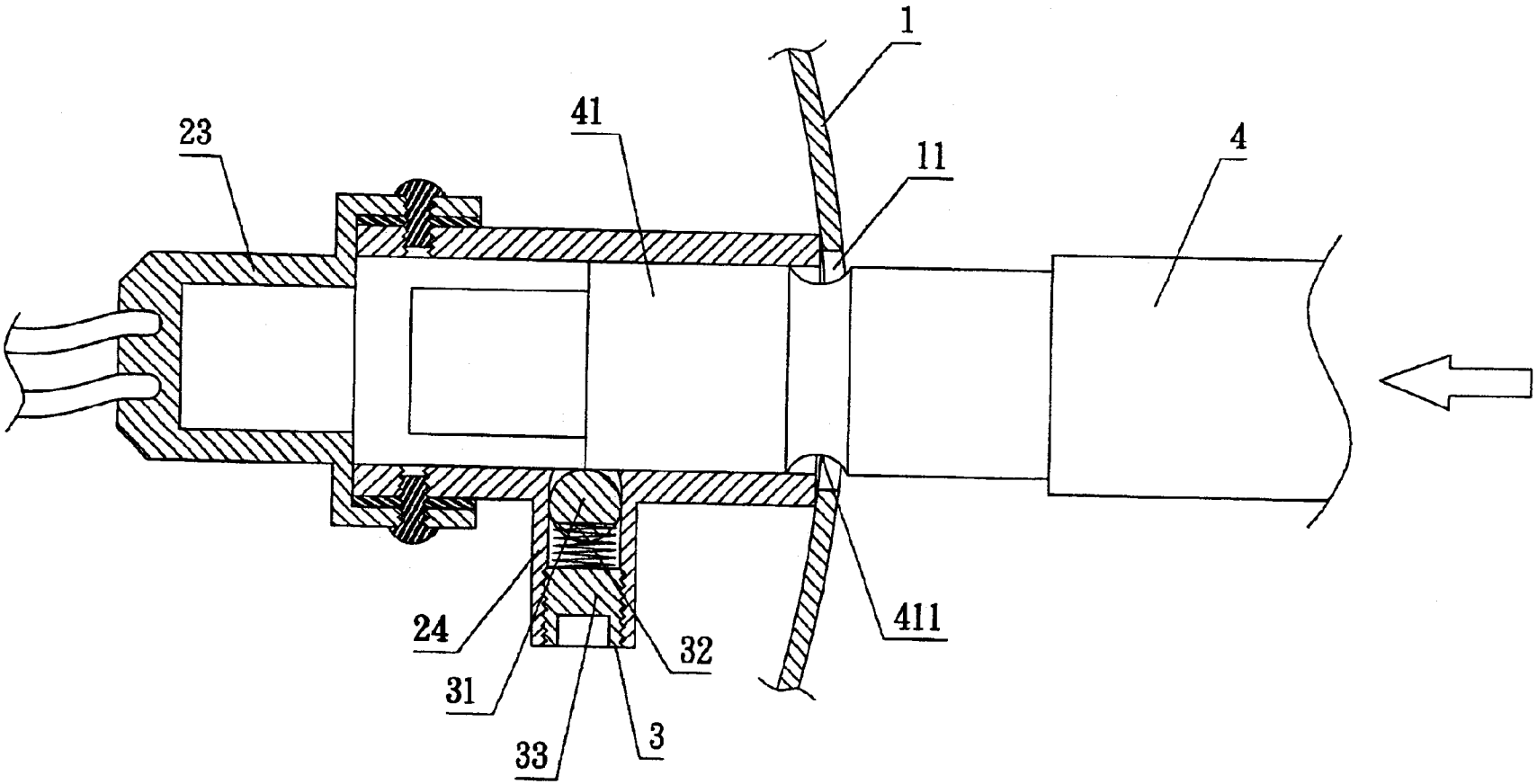
FIG. 3A is a cross-sectional diagram illustrating the inserting lamp rod according to the present invention.
Figure 3B:
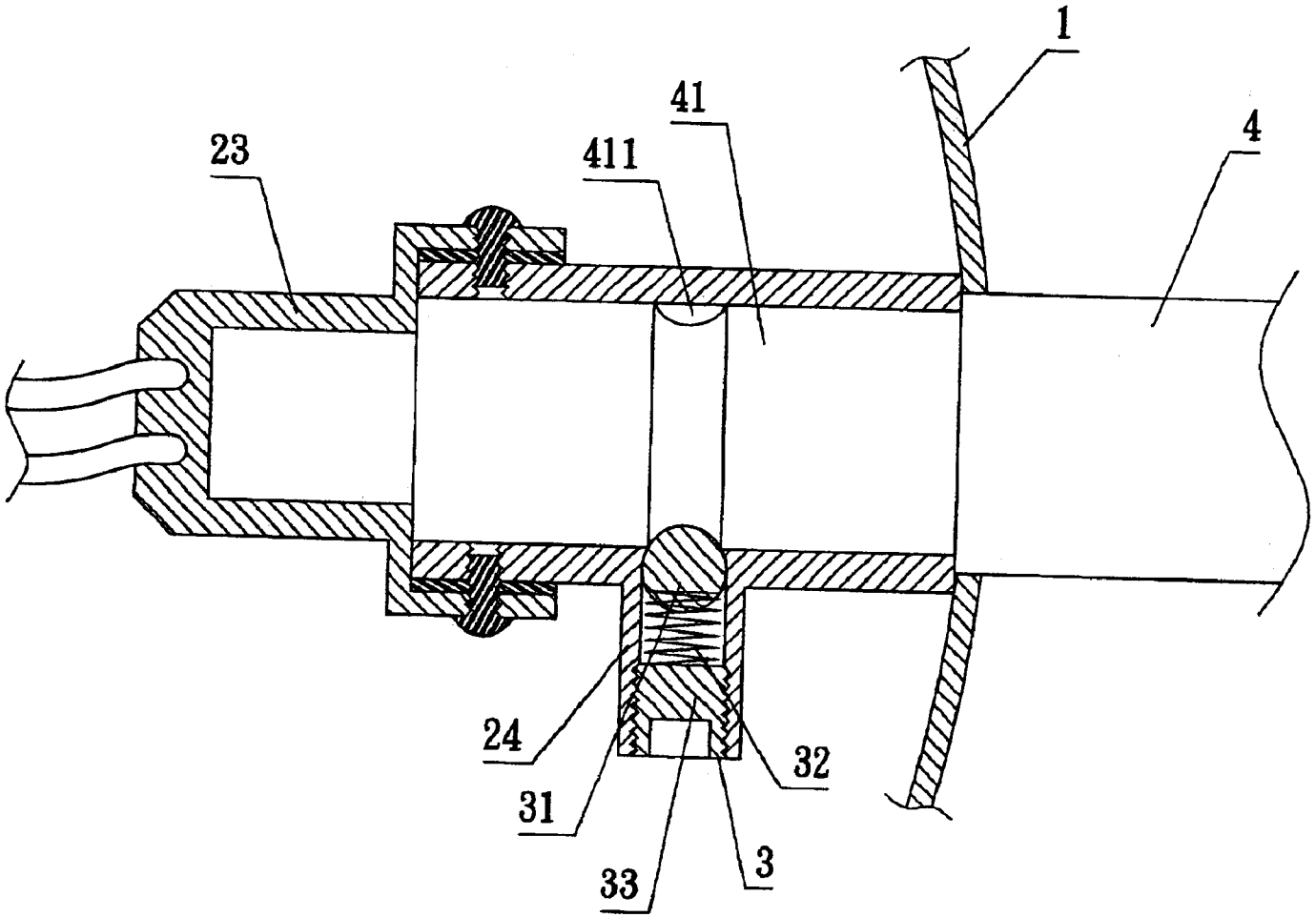
FIG. 3B is a cross-sectional diagram illustrated the inserted lamp rod according to the present invention.

Please refer to FIG. 3. By means of the guiding hole 24 protruded from the side of the lamp base 2 and the blocking groove 411 disposed at a position on the head 41 corresponsive to the embedding member 3 of the lamp base 2, the lamp rod 4 can be inserted into the sheathing hole 21 of the lamp base such that the head 41 of the lamp rod 4 can exactly press against the steel ball 31 of the embedding member 3 and in turn compress the spring 32 backward (as shown in FIG. 3A). After the lamp rod 4 is inserted, the resumption of the spring 32 will push the steel ball 31 back into its original position, and the steel ball 31 will be stuck into the blocking groove 411 of the lamp rod 4 in order to insert the lamp rod 4 into the lamp base 2, and both of the lamp base 2 and lamp rod 4 are electrically connected (as shown in FIG. 3B).

Figure 4:
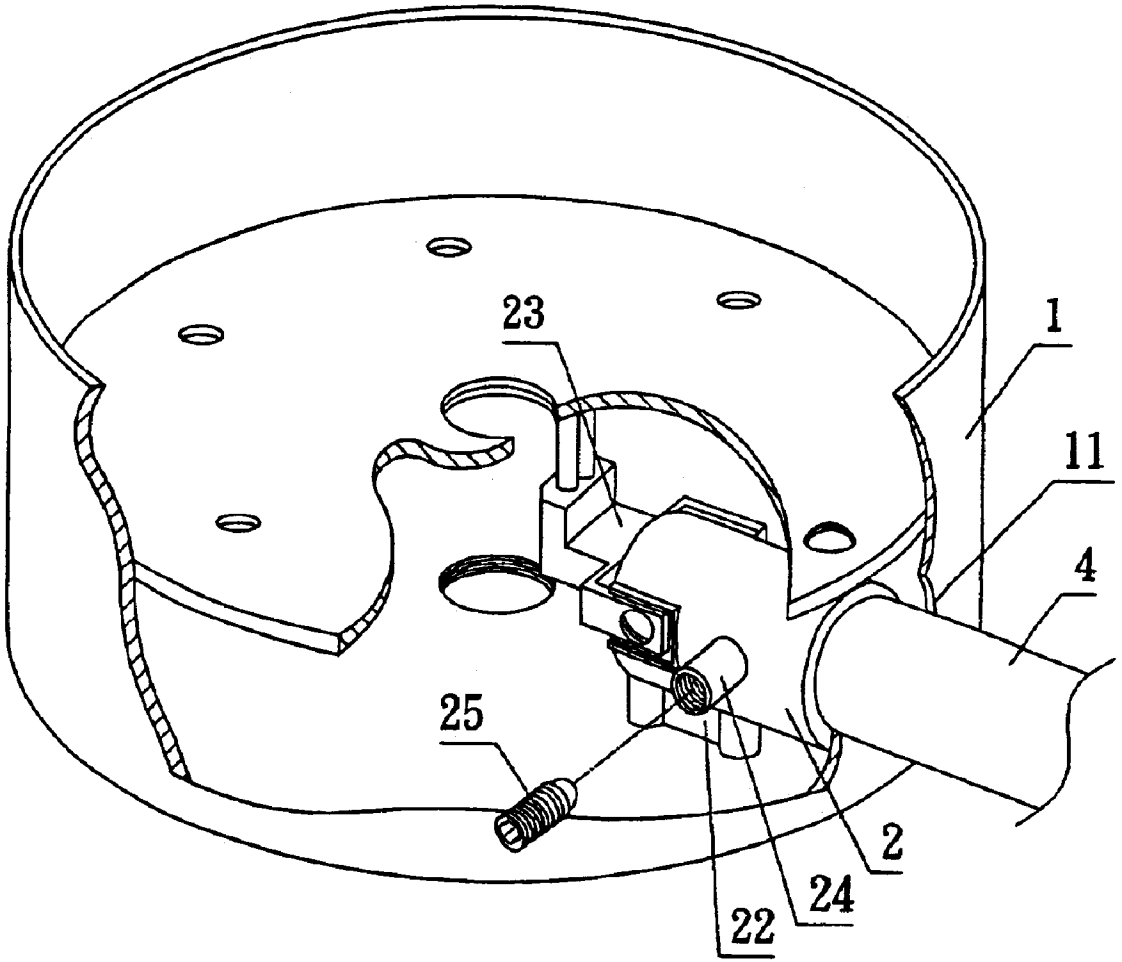
FIG. 4 is a diagram of the embedded structure of another preferred embodiment of the present invention

Please refer to FIG. 4. The embedding member 3 on the guiding hole 24 of the lamp base could also be directly secured by a screw bolt 25 such that the front end of the screw bolt 25 can be latched to the blocking groove 411 of the lamp rod in order to insert the lamp rod 4 into the lamp base 2, and both of the lamp base 2 and the lamp rod 4 are electrically connected.

The lamp base 2 for receiving the embedding member 3 can be installed in the wire connection box 1 beforehand, so that after the user has bought the lamp, the user just needs to insert the lamp rod 4 into the wire connection box 1 of the lamp base 2 for the application, and does not require any screwing device such as screw bolt to attain the function of facilitating users to assemble the lamp on their own.

In summation of the above description, the present invention herein enhances the performance than the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connecting structure for a lamp, comprising:

a lamp rod;

a lamp base;

the lamp base coupled to a side of a wire connection box;

an embedding member in the lamp base;

a lamp rod inserted into the lamp base;

the wire connection box further comprising a through hole, and having the lamp base at its bottom surface;

the lamp base comprising a sheathing hole at the position corresponsive to the through hole of the wire connection box; a socket coupled to the end of the lamp base for receiving the insertion of the lamp rod; and a guiding hole on a side of the lamp base for engaging the embedding member;

the embedding member, further comprising a steel ball placed in a guiding groove of the lamp base in advance, a spring disposed behind the steel ball, and a stopcock disposed at the rear end of the spring; and the front-end diameter of the guiding hole is slightly smaller than the diameter of the steel ball;

the lamp rod having a head;

the lamp rod head being substantially in a shape corresponsive to the shape of the sheathing hole, and the head having a blocking groove at the position corresponsive to the embedding member of the lamp base;

the blocking groove and the embedding member cooperating such that the head, when inserted into the sheathing hole, is secured therein;

the head continuing into the socket of the lamp base to conduct electricity, after the lamp rod being inserted into the sheathing hole;

such arrangement facilitating assembly by providing both mechanical and electrical connection by just inserting the lamp rod into the lamp base.

2. An electrical connecting structure for a lamp, as claimed in claim 1, wherein:

said lamp base further comprises a locking base corresponsive to a screw hole of the wire connection box;

the locking base being disposed at the bottom of the lamp base for receiving a screw bolt passing through the screw hole at the bottom of the wire connection box and being secured on the locking base in order to fix the lamp base to the interior of the wire connection box.

3. An electrical connecting structure for a lamp, as claimed in claim 1, wherein:

said sheathing hole is a substantially rectangular hole with both lateral sides curved.

* * * * *